US006267201B1

(12) United States Patent
Cunniffe

(10) Patent No.: US 6,267,201 B1
(45) Date of Patent: Jul. 31, 2001

(54) WORK PLATFORM FOR ROOF CONSTRUCTION WORK

(76) Inventor: Nigel James Cunniffe, Factory 9, 260 Wickham Road, Moorabbin, Victoria 3189 (AU)

( * ) Notice: Subject to any disclaimer, the term of this patent is extended or adjusted under 35 U.S.C. 154(b) by 0 days.

(21) Appl. No.: 09/524,019

(22) Filed: Mar. 13, 2000

Related U.S. Application Data

(63) Continuation-in-part of application No. 09/033,683, filed on Mar. 3, 1998, now abandoned.

(51) Int. Cl.[7] ..... E04G 3/12
(52) U.S. Cl. ..... 182/45; 182/113
(58) Field of Search ..... 182/45, 113, 186.7

(56) References Cited

U.S. PATENT DOCUMENTS

| | | | | |
|---|---|---|---|---|
| 4,050,257 | | 9/1977 | Parks . | |
| 4,371,139 | | 2/1983 | Clark . | |
| 4,676,341 | | 6/1987 | Shaffstall . | |
| 4,689,927 | * | 9/1987 | Green | 182/45 |
| 4,919,230 | | 4/1990 | Langer . | |
| 4,986,389 | | 1/1991 | Halligan, Sr. et al. . | |
| 5,638,914 | | 6/1997 | Kizzia . | |
| 5,820,092 | * | 10/1998 | Thaler | 248/237 |

FOREIGN PATENT DOCUMENTS

| | | |
|---|---|---|
| 272891 | 10/1989 | (DE) . |
| 0413510A1 | 2/1991 | (EP) . |
| 2596441 | 2/1987 | (FR) . |
| 1026531 | 4/1966 | (GB) . |
| 2127081 | 4/1984 | (GB) . |
| 2157755A | 10/1985 | (GB) . |
| 2192660 | 1/1988 | (GB) . |

* cited by examiner

*Primary Examiner*—Alvin Chin-Shue
(74) *Attorney, Agent, or Firm*—Traskbritt, PC

(57) ABSTRACT

A method of performing roof construction work on a roof with inclined rafters using a work platform which includes a structural frame (10), an upper work surface (15) having multiple removable sections (16) mounted by the frame on which a worker can move about on the platform. A safety barrier (20) extends around the periphery of the upper work surface. Mounting feet (30) secured to the frame are located at predetermined positions enabling the feet to rest on the rafters and releasable fastening means (31, 41) are associated with the feet to secure the platform in position for work on the roof structure. The mounting feet (30) include abutment feet (40) which rest on the rafters of the roof structure and which are clamped to the rafters. At least one mounting foot (30) comprises a fixable mounting foot (31) which can be releasably fastened to the roof structure to prevent lifting movement, longitudinal sliding movement, and lateral displacement of the work platform relative to the associated rafter. The method involves lifting the platform as a unit and securing it to the roof parallel to the rafters enabling work on the roof below the upper work surface. Roof materials can be slung below the frame for their removal from the roof and for lifting of new materials into position.

5 Claims, 5 Drawing Sheets

WORK PLATFORM FOR ROOF CONSTRUCTION WORK

CROSS REFERENCE TO RELATED APPLICATION

This application is a continuation-in-part of application Ser. No. 09/033,683, filed Mar. 3, 1998, abandoned.

BACKGROUND OF THE INVENTION

1. Field of the Invention

This invention relates to apparatus or systems for use in roof construction work, particularly but not exclusively for large industrial buildings during erection or maintenance of roof structures.

2. State of the Art

The construction and more particularly the maintenance, repair or replacement of roof structures in large industrial buildings such as factory roofs presents numerous problems, particularly with ensuring the safety of workers. For example, factory roof structures sometimes need major work including replacement as a result of deterioration after years of use. Some factories produce or use corrosive substances which are present in the atmosphere in the factory and over periods of time can cause severe corrosion of roof structures including the roofing materials and the support structure for the roofing materials including particularly roof purlins. Such corrosion and deterioration of roofing materials and the roof support structure can make it particularly dangerous to attempt to repair or replace the roof structure by walking on the roof. To solve this problem it has been usual in the past to erect scaffolding within the factory to enable the maintenance or replacement of the roof structure by workmen supported by the temporary scaffolding erected for the purpose. However, the erection and disassembly of such scaffolding can be time consuming and expensive and can substantially interfere with normal operations in the factory.

U.S. Pat. No. 4,676,341 (Shaffstall) discloses a pitched roof mounted construction scaffold for providing a horizontal platform enabling work to be carried out on a vertical or inclined surface adjacent to the pitched roof on which the scaffold is erected. The scaffold is not movable.

U.K. patent specification 2,192,660 (Robathan) discloses a kit of parts for assembly into a pitched roof mounted construction scaffold. Robathan also provides a horizontal platform enabling work to be carried out beyond the boundary of the platform. The Robathan scaffold is assembled in situ and is not movable.

Each of Shaffstall and Robathan provides a scaffold which rests at its lower end on the roof itself and the roof drops further away from the horizontal platform in the outwards direction, so neither enables work to be carried out on the pitched roof itself

SUMMARY OF THE INVENTION

It is an object of the present invention to provide a method of performing roof construction work which can enable erection, maintenance, repair, or replacement work to be carried out on a roof structure in an effective manner.

According to the present invention there is provided a method of performing roof construction work on a roof having inclined rafters, the method comprising the steps of: providing a frame, an upper work surface secured to the frame, a safety barrier disposed about the frame and a plurality of mounting feet secured to the frame to support the upper working surface spacedly above the inclined rafters and generally parallel thereto; lifting the frame into a position on top of the roof; securing the frame to the rafters of the roof wherein the upper work platform is positioned generally parallel to the inclined rafters and sufficiently above the roof such that workers positioned on the work surface may perform operations on the roof; and performing roof construction work on the roof from a position atop the upper work surface.

Preferably the method further includes the step of performing roof construction work to that portion of the roof positioned elevationally below the upper work surface.

In one possible embodiment, the upper work surface further includes a removable panel, which is removable to define an opening in the upper work surface, and the method further includes the step of removing the panel to permit a workman positioned on the upper work surface to access the roof through the opening so as to perform roof construction work on the roof. For safety purposes there may be a mesh provided beneath the panel configured to preclude passage of a workman through the opening.

For roof repair or maintenance or replacement purposes, the step of performing roof construction work on the roof may comprise the step of removing material from the roof and securing the material to the frame so as to be slung beneath the frame. The method may further include the steps of lifting the work platform from the roof together with the material from the roof slung beneath the frame and lowering the frame together with the material from the roof slung beneath the frame to the ground.

For roof erection or replacement purposes, the method may include the step of releasably securing roofing materials for the roof to an underside of the frame prior to the step of lifting the frame into a position on top of the roof, followed by lifting the frame into position on top of the roof so that the roofing materials are positioned as desired on the roof, the step of performing roof construction work on the roof comprising fastening the roofing materials secured to the underside of the frame to the roof.

For use in the method of the present invention, I have developed a work platform for roof construction work useable on a roof structure in which there are spaced parallel rafters for supporting roofing materials, the work platform including a structural frame, an upper work surface mounted by the frame on which a worker can move about on the platform, a safety barrier around at least part of the periphery of the upper work surface, a plurality of mounting feet secured to the frame and located at predetermined positions enabling the feet to rest on the rafters of the roof structure with the feet supporting the work surface a short distance above the rafters so that the worker can perform work on the roof structure, and releasable fastening means associated with at least two of the feet and operable to secure the platform in position for work on the roof structure and being releasable to enable the platform to be moved.

Preferably the upper work surface includes multiple removable sections which are independently removable temporarily by the worker to enable access to an area of the roof structure below the work surface where a respective one of the removable sections has been removed.

In this embodiment, the upper work surface may include a walkway extending generally around the perimeter of the frame, and the walkway may comprise a number of selectively removable panels constituting the removable sections so that the worker can remain on one panel of the work surface and access an area below the adjacent removed panel. The removable sections of the work surface may be hinged to the frame for hinging movement upwardly.

The mounting feet may include abutment feet which rest on the rafters of the roof structure and which are clamped to the rafters by the releasable fastening means. In this embodiment, each of the releasable fastening means may comprise a clamping means which acts between the respective foot and the rafter to prevent lifting movement of the abutment foot relative to the rafter and to prevent movement of the abutment foot transverse to the longitudinal line of the rafter. In the case where the rafter comprises a steel I-beam having in section an upright web and upper and lower transverse flanges, the abutment foot may include a plate for resting on the top of the rafter, and the clamping means may comprise hooked members which extend downwardly from the plate and which project beneath the upper transverse flanges of the I-beam cross section.

In an alternative embodiment, or in a work platform having different types of mounting feet at least one mounting foot may comprise a fixable mounting foot which can be releasably fastened to the roof structure to prevent lifting movement, longitudinal sliding movement, and lateral displacement of the work platform relative to the associated rafter.

BRIEF DESCRIPTION OF THE SEVERAL VIEWS OF THE DRAWINGS

Possible and preferred features of the present invention will now be described with particular reference to the accompanying drawings. However it is to be understood that the features illustrated in and described with reference to the drawings are not to be construed as limiting on the scope of the invention. In the drawings.

DETAILED DESCRIPTION OF THE INVENTION

Figure 1:
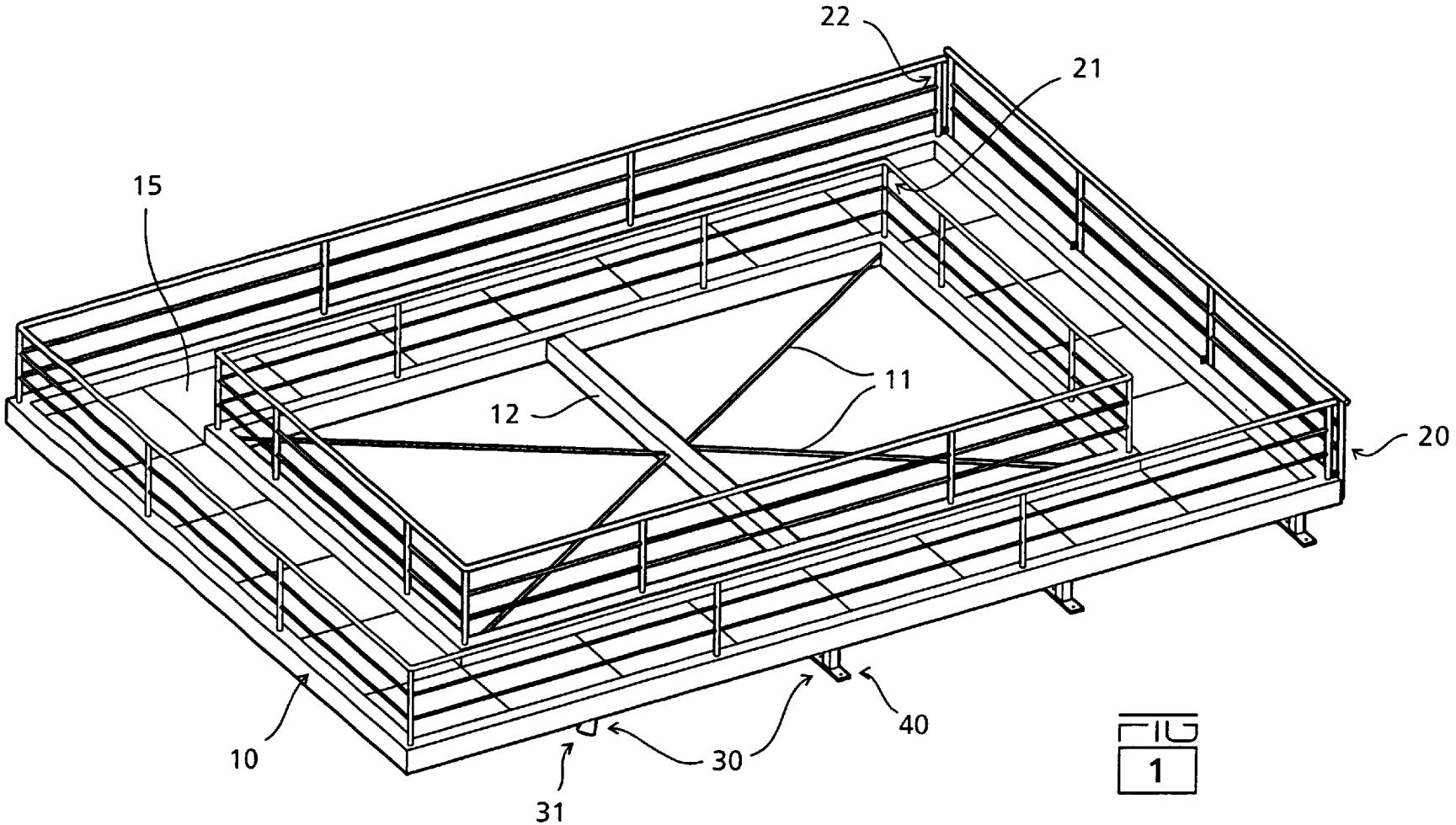
FIG. 1 is a schematic perspective view of a work platform useable in the method according to the present invention.

A work platform useable in the method according to the present invention will first be described by referring to the drawings. The method of roof work according to the invention will then be described. In the drawings, the work platform comprises a frame 10 made of any suitable material such as metal sections bolted or otherwise fastened together so as to provide a rigid structural mounting for other parts. For example, the frame can include diagonal bracing rods 11 extending from the four corners to a transverse strut 12 so that the frame is torsionally rigid. The width of the frame is substantially equal to or slightly larger than the spacing between adjacent rafters 13 (although for some possible applications, the width may be substantially equal to the spacing between every second, every third, etc. rafter if access from the platform to intermediate rafters is required). The length of the platform is preferably generally about the length of the rafters of the roof structure so that when the platform is in position and supported by the adjacent rafters 13, a worker by moving around the periphery of the platform can have access to the lengths of the two rafters along the long sides of the platform, to the ridge 14 of the building along the upper short side, and to the outer lower edge of the roof structure along the opposite short side of the platform.

Around the outer periphery of the frame 10 there is an upper work surface 15 mounted by the frame 10 and on which the worker can move about on the platform. The upper work surface can be made of any suitable construction and materials and in the illustrated embodiment comprises a grid material suitable for supporting the weight of the person. The work surface 15 is made of multiple sections, such as panels 16 which have peripheral frames 17 to which the grid material 18 on which the worker walks is mounted (see FIG. 3). Each panel frame 17 can be mounted to the frame 10 of the platform by hinges 19 so that each work surface section or panel 16 can be independently removable by hinging upwardly to enable access to the area below the removed section. If desired, below the movable sections of the work surface there may be provided a relatively open safety mesh 48 having relatively large openings sufficient to enable the worker to carry out operations beneath the mesh but being sufficiently small to prevent a worker falling through.

A safety barrier 20 is provided around the platform. As illustrated, this can comprise an inner safety barrier 21 provided around the inner perimeter of the circumferential work surface 15 and an outer safety barrier 22 around the outside. The inner and outer safety barriers 21, 22 are comprised by upright posts mounted to the frame 10 and multiple safety rails or lines 49 extending between adjacent posts.

Figure 2:
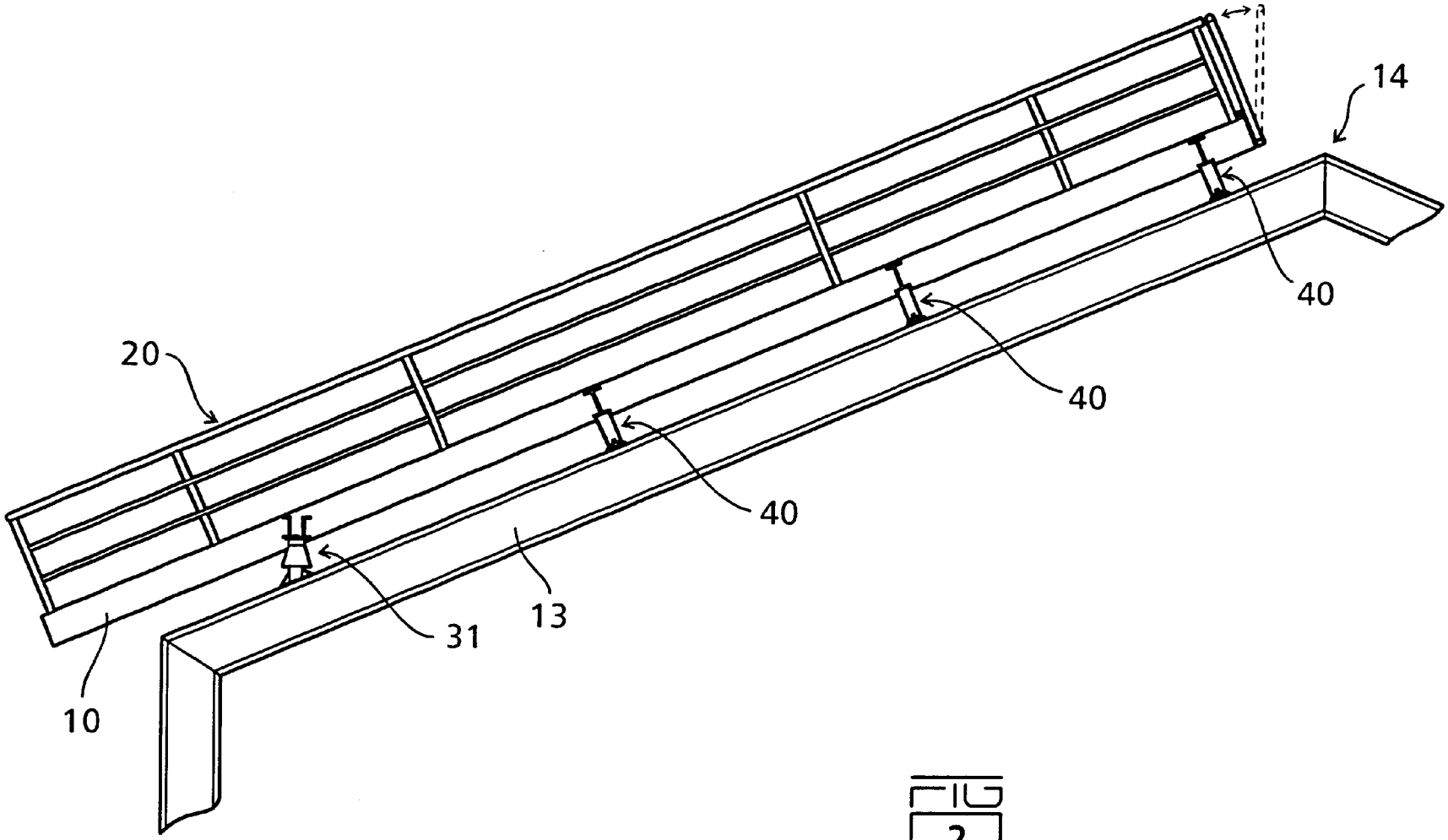
FIG. 2 is a side view of the work platform of FIG. 1 in use on a roof structure.
Figure 3:
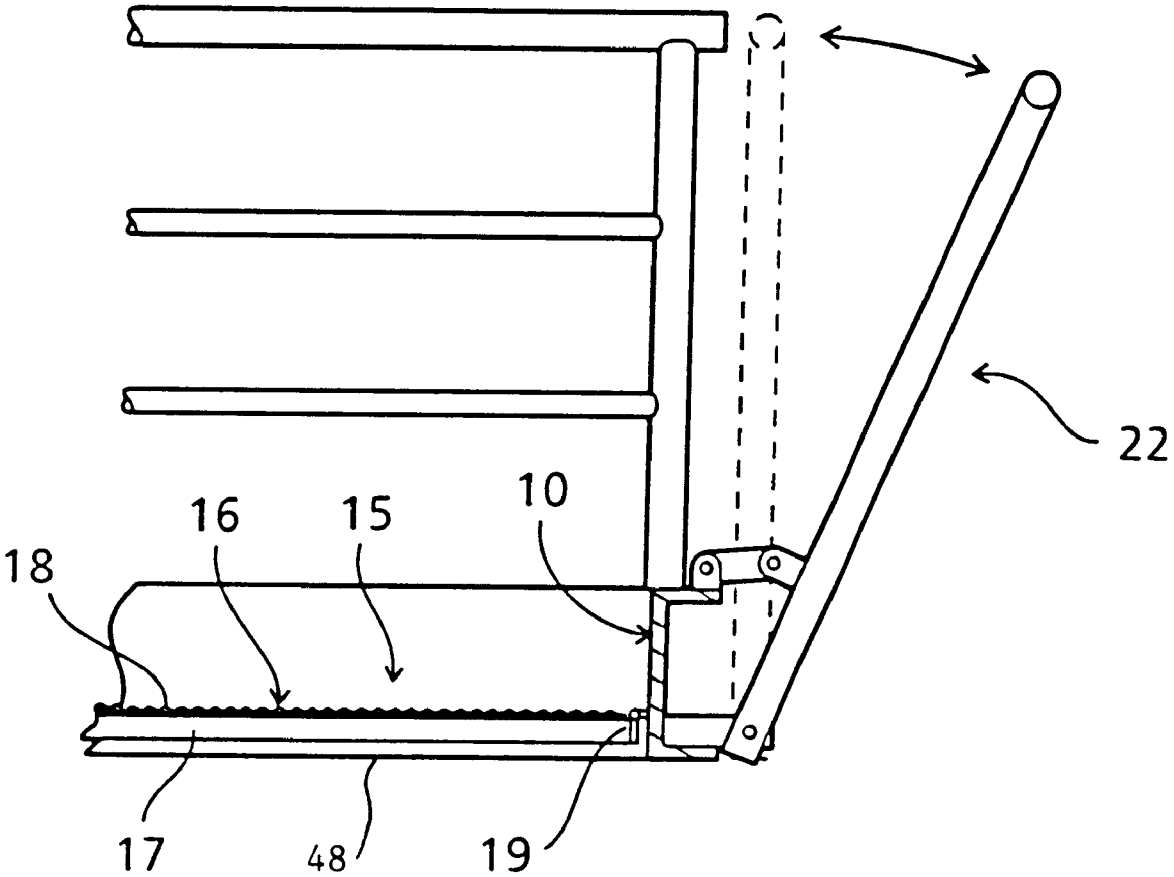
FIG. 3 is a side sectional view of a safety barrier and the work surface.

As shown in FIG. 3, the outer safety barrier 22 at the upper end of the platform can be mounted at point 50 to the frame 10 for hinging movement outwardly. The purpose of enabling outward hinging movement to the limited extent illustrated by arrow A where the safety barrier can be fixed is to enable more easy access to the ridge 14 of the roof structure when the platform is mounted in position on an inclined roof structure as shown in FIG. 2.

Figure 4:
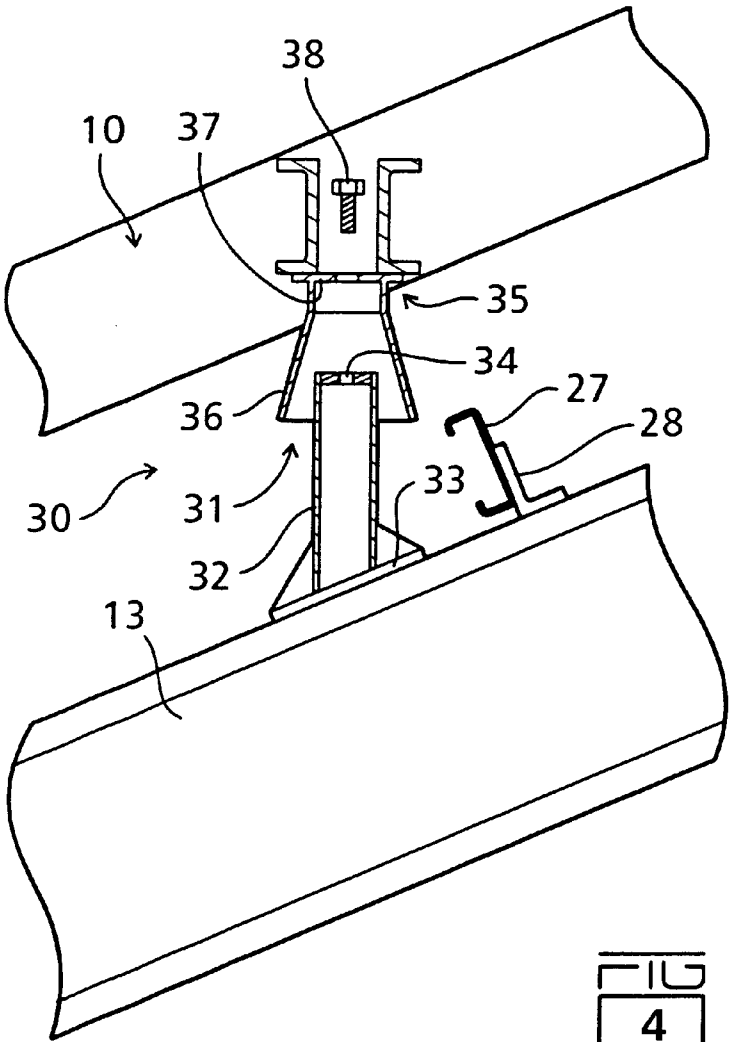
FIG. 4 is a detailed view of a fixable support foot arrangement.

Mounting feet 30 are secured to the frame 10 and located at predetermined positions along the long sides of the rectangular frame so that in use the feet rest on the rafters 13 of the roof structure. In the illustrated embodiments, there are two kinds of mounting feet respectively illustrated in FIGS. 4 and 5. In FIG. 4 there is a fixable support foot arrangement 31 enabling the platform to be secured to the rafter 13 and restrained against movement in all directions. The arrangement 31 comprises a short upright post 32 which is securely fastened to the rafter 13, e.g. by welding or bolting of the base plate 33 to the upper surface of the rafter. The post 32 is substantially vertical so that as the platform is lowered into position it will be engaged by the cooperating means 35 mounted beneath the platform. The cooperating means 35 comprises a guide cone 36 which helps to guide the platform into position as it is being lowered. The cooperating means 35 includes a cap plate 37 which rests on the top of the post 32. The cap plate 37 is provided by or is secured to a part of the frame 10. To fix the cooperating means 35 to the post 32, the cap plate 37 is provided with an aperture which aligns with a threaded hole 34 provided in the top of the post 32, enabling a fixing bolt 38 to be installed to thereby fix the platform against movement in all directions including lifting and longitudinal and lateral movement relative to the line of the rafter 13. Of course it will be appreciated that other suitable fixing arrangements can readily be devised to suit the same purpose as the fixing or fastening arrangement illustrated in the FIG. 4.

Figure 5:
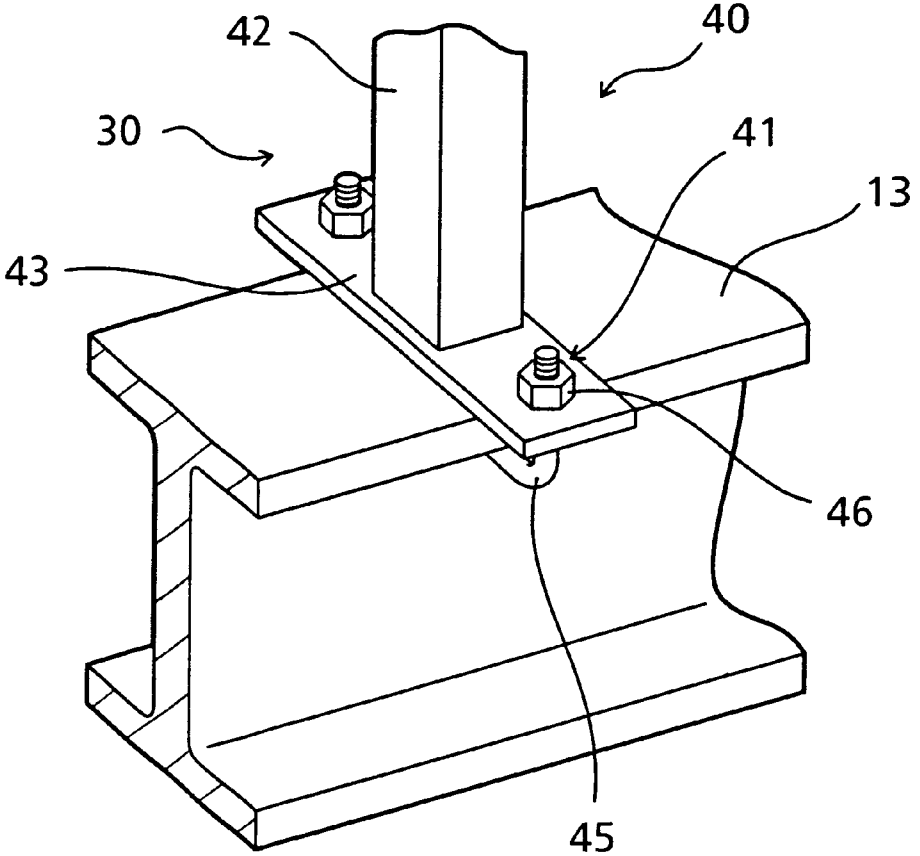
FIG. 5 is a detailed perspective view of an abutment foot arrangement.

FIG. 5 illustrates an abutment foot 40 which is arranged to rest on the rafter 13 and to be secured to the rafter by releasable fastening means 41. The abutment foot comprises a short leg 42 secured to and extending downwardly from the frame and having an abutment foot plate 43 welded or otherwise secured to the bottom of the leg 42. The fastening means 41 comprises 'L' shaped bolts 45 and cooperating nuts 46 which can be installed and tightened to clamp the foot plate 43 to the top of the rafter 13. It will be seen that this arrangement fastens the platform against lifting movement and against lateral movement of the platform relative to the longitudinal line of the rafters. However the fastening means 41 can conceivably allow longitudinal movement of the platform by sliding along the line of the rafters, and hence the work platform preferably includes at least two fastening means which restrain movement of the work platform in the longitudinal direction of the rafters, such fastening means being for example of the kind shown in FIG. 4.

When the work platform illustrated in the drawings is mounted in position on a roof structure with the plurality of mounting feet being located between the transverse purlins, it is possible for workers on the platform to carry out erection, maintenance, repair and replacement work on the roof structure. In particular, the method involves lifting the frame into a position on top of the roof, securing the frame to the rafters of the roof with the upper work platform positioned generally parallel to the inclined rafters and sufficiently above the roof such that workers positioned on the work surface may perform operations on the roof, and then performing roof construction work on the roof from a position atop the upper work surface.

By providing the work surface parallel to and spaced a short distance above the roof, roof construction work can be carried out to that portion of the roof positioned elevationally below the upper work surface.

Because the upper work surface includes removable panels which are removable to define openings in the upper work surface, the removal of the panels permits a workman positioned on the upper work surface to access the roof through the opening so as to perform roof construction work on the roof. The mesh beneath the panels precludes passage of a workman through the openings.

The roof construction work on the roof can comprise removing material from the roof and securing the material to the frame so as to be slung beneath the frame. The method can further include the steps of lifting the work platform from the roof together with the material from the roof slung beneath the frame and lowering the frame together with the material from the roof slung beneath the frame to the ground. For example, to remove and replace corroded or otherwise structurally unsound purlins, the worker can move around the platform tying or tethering the existing installed purlins 27 (FIG. 4) to the underside of the platform prior to dismounting the purlins from the mounting cleats 28. By doing this, when the worker unfastens the purlins 27 from the cleats 28, the worker does not need to be concerned to simultaneously hold the purlins so they do not fall into the building below. When all the purlins have be unfastened, the entire platform can be unfastened from its releasable fastening to the rafters and the platform with the purlins slung underneath can be lifted and lowered to the ground by crane.

The method can further include the step of releasably securing roofing materials for the roof to an underside of the frame prior to the step of lifting the frame into a position on top of the roof, followed by lifting the frame into position on top of the roof so that the roofing materials are positioned as desired on the roof the step of performing roof construction work on the roof comprising fastening the roofing materials secured to the underside of the frame to the roof. In the particular example referred to above, after removal of the old purlins, new purlins can be slung underneath the platform generally in their required positions and the platform lifted and reinstalled on the adjacent rafters. The worker can then move around the platform securing the new purlins to the cleats and releasing the tethering lines by which the purlins were slung beneath the platform.

To enable lifting of the entire platform, e.g. by crane, there may be provided a lifting harness comprised by chains or cables extending inwardly from the four comers to a central position where the crane can be coupled to the harness.

It will be understood from the preceding description and accompanying drawings that the present invention provides an effective solution to the problem of enabling work on a roof structure, particularly one having structurally unsound roofing material and purlins. The work can include maintenance, repair and replacement of the roof structure.

What is claimed is:

1. A method of performing roof construction work on a roof having inclined rafters said method comprising the steps of:

providing a frame, an upper work surface secured to said frame, a safety barrier disposed about said frame and a plurality of mounting feet secured to said frame to support said upper working surface spacedly above said inclined rafters and generally parallel thereto;

lifting said frame into a position on top of said roof;

securing said frame to said rafters of said roof wherein said upper work platform is positioned generally parallel to said inclined rafters and sufficiently above said roof such that workers positioned on said work surface may perform operations on said roof;

performing roof construction work on said roof from a position atop said upper work surface, wherein said upper work surface further includes a removable panel, which is removable to define an opening in said upper work surface, said method further including the step of removing said panel to permit a workman positioned on said upper work surface to access said roof through said opening so as to perform roof construction work on said roof; and providing a mesh beneath said panel configured to preclude passage of a workman through said opening.

2. The method of claim 1 further including the step of performing roof construction work to that portion of the roof positioned elevationally below said upper work surface.

3. The method of claim 1 wherein said step of performing roof construction work on said roof comprises the step of removing material from said roof and securing said material to said frame so as to be slung beneath said frame.

4. The method of claim 3 further including the steps of lifting said work platform from said roof together with said material from said roof slung beneath said frame sad lowering said frame together with said material from said roof slung beneath said frame to the ground.

5. The method of claim 1 further including the step of releasably securing roofing materials for said roof to an underside of said frame prior to said step of lifting said frame into a position on top of said roof followed by lifting said frame into position on top of said roof so that said roofing materials are positioned as desired on said root, said step of performing roof construction work on said roof comprising fastening said roofing materials secured to said underside of said frame to said roof.

* * * * *